United States Patent [19]

Andis

[11] 4,358,660

[45] Nov. 9, 1982

[54] COLLAPSIBLE ELECTRIC HAIR CURLING IRON

[75] Inventor: Matthew L. Andis, Racine, Wis.

[73] Assignee: Andis Company, Racine, Wis.

[21] Appl. No.: 120,511

[22] Filed: Feb. 11, 1980

[51] Int. Cl.[3] ..... A45D 2/08; A45D 2/36; H05B 3/06

[52] U.S. Cl. ..... 219/222; 132/11 R; 132/37 A; 132/85; 132/122; 132/142; 132/150; 219/236; 219/533; 219/534; 219/544

[58] Field of Search ..... 219/222–235, 219/221, 227, 229, 236–241, 523, 533, 544, 534; 132/37 R, 37 A, 31 R, 32 R, 9, 11 R, 85, 118, 122, 142, 150

[56] References Cited

U.S. PATENT DOCUMENTS

| | | | |
|---|---|---|---|
| 1,710,511 | 4/1929 | Petrie | 219/534 |
| 3,578,947 | 5/1971 | McNair | 219/226 |
| 3,973,528 | 8/1976 | Walter et al. | 132/11 R |
| 4,101,757 | 7/1978 | Van Dyck et al. | 219/225 |
| 4,215,264 | 7/1980 | Hetherington | 219/533 X |

FOREIGN PATENT DOCUMENTS

| | | | |
|---|---|---|---|
| 517115 | 12/1920 | France | 132/37 R |
| 1548540 | 7/1979 | United Kingdom | 219/222 |
| 1558737 | 1/1980 | United Kingdom | 132/11 R |

*Primary Examiner*—A. Bartis
*Attorney, Agent, or Firm*—Michael, Best & Friedrich

[57] ABSTRACT

A collapsible electric curling iron includes an elongated hollow handle open at one end and an elongated, generally cylindrical heat conductive housing mounted on the handle for movement between an operative use position where the housing extends out of the handle through the open end and an inoperative storage position where the housing is confined within the handle. A cap on the inner end of the housing cooperates with a collar and guides on the handle to prevent side-to-side or "rocking" movement of the housing in a direction transverse to the longitudinal axis of the handle during movement between the operative and inoperative positions. The housing has a longitudinal bore, generally polygonal in transverse cross section, which accommodates a thin planar electric heating element placed diagonally across the bore and having side edges engaged in diametrically spaced corners of the bore. Hair grooming members in the form of rows of aligned combining teeth or bristles are removably received in longitudinal grooves in the outer peripheral surface of the housing.

13 Claims, 5 Drawing Figures

58
46
80
42
44
14
28
48
4
59
12
4
52
38
42
18
82
10

58
80
48
59
12
52
82

20
52
56
48
54
28
49
14
16
24
42
18
44
80
80A
58
60
46
50
70
72
78
68
66
12
76
50
70
59

14
32b
18
24
30
38
35
38
30
32a
34
28
26
32a
20
ELECTRIC HEATING ELEMENT
16
38
30
32b
38
34

COLLAPSIBLE ELECTRIC HAIR CURLING IRON

FIELD OF THE INVENTION

The invention generally relates to hair grooming devices. More particularly, the invention relates to curling irons.

DESCRIPTION OF THE PRIOR ART

Curling irons are widely used to curl or otherwise style hair. Typically, a curling iron includes a handle and a heat conducting member which extends from the handle and which houses therein the heating element of the curling iron.

In one type of construction, the curling iron is collapsible, meaning that the heat conducting member of the curling iron is movable between an extended position, in which the heat conducting member extends outwardly of the curling iron handle, and a retracted or collapsed position, in which the heat conducting member is substantially wholly confined within the handle of the curling iron.

It is desirable to prevent side-to-side or "rocking" movement of the heat conducting member of a collapsible curling iron. None of the collapsible curling irons known to applicant positively retrains the heat conducting member against all such "rocking" movement, particularly when the heat conducting member is fully extended from the handle. Furthermore, none of the curling irons known to applicant, collapsible or otherwise, utilizes a heat conducting member having a rectilinear bore in which the heating element is diagonally supported.

SUMMARY OF THE INVENTION

The invention provides in part a heat conducting member for a curling iron, which heat conducting member contains therein the heating element of the curling iron. The heat conducting member comprises a housing having a longitudinal axis and interior wall means defining a chamber having a generally rectilinear cross section disposed perpendicularly to the longitudinal axis. The interior wall means includes means for supporting the heating element of the curling element axially within and diagonally across the interior chamber of the housing.

In one embodiment of the heat conducting member, the housing includes a generally cylindrical outer peripheral surface radially spaced about the longitudinal axis, and the interior wall means includes adjoining, generally planar interior sidewalls spaced inwardly of the outer peripheral housing surface. The planar interior sidewalls collectively form the rectilinear cross section of the interior chamber. In this embodiment, means is provided for defining a groove extending on the outer peripheral surface of the housing axially of the longitudinal axis and radially of each of the planar sidewalls. A support bar having a plurality of outwardly extending teeth can be engaged in each of these grooves, thereby collectively defining a hair grooming attachment for the heat conducting member.

In one embodiment of the heat conducting member, the interior wall means includes diametrically spaced pairs of corner areas formed by the juncture of the planar interior sidewalls. In this embodiment, the supporting means includes means on one of the pairs of corner areas for defining a diametrically spaced pair of axially extending channels engagable with the heating element of the curling iron.

The invention also provides a curling iron comprising a handle, a heating element adapted to be connected to a source of electrical energy, and a housing which extends from the handle and which has a longitudinal axis. The housing is generally of the construction as described above and includes interior wall means for defining a chamber having a generally rectilinear cross section perpendicular to the longitudinal axis. Also as generally described above, the interior wall means includes means engaging the heating element for supporting the heating element axially within and diagonally across the interior chamber.

The invention also provides a collapsible curling iron comprising a handle having opposite ends and an interior opening at one of the ends, a heating element adapted to be connected to a source of electrical energy, and a housing for the heating element, which housing has oppositely spaced first and second ends and a longitudinal axis extending therebetween. The housing has a bore extending along the longitudinal axis, in which bore the heating element is accommodated. Means is provided on the handle and on the first end of the housing for mounting the first end of the housing on the handle for movement of the housing relative to the handle axially along the longitudinal axis between an inoperative or collapsed position, in which the housing is substantially wholly confined within the interior opening of the handle, and an operative or extended position, in which the housing extends from one end of the handle. Means is also provided on one end of the handle for supporting the housing to prevent movement of the housing relative to the handle in a direction transverse the longitudinal axis while permitting movement of the housing between the inoperative and operative positions.

In one embodiment of the invention, the supporting means of the collapsible curling iron supports the housing adjacent to the first end thereof when the housing is in its operative position and supports the housing adjacent to its second end thereof when the housing is in its inoperative position.

In one embodiment of the invention, the collapsible curling iron further includes a hair grooming attachment carried by the housing and including a plurality of longitudinally and arcuately spaced teeth extending from the housing. In this embodiment, when the housing is in its inoperative position, the housing and the radially extending teeth are substantially wholly confined within the interior opening of the handle and, when the housing is in its operative position, the housing and the radially extending teeth extend from one end of the handle. In this embodiment, the housing includes a generally cylindrical outer peripheral surface having a first diameter, and the teeth extend a given radial distance outwardly of the outer peripheral surface. In this embodiment, the supporting means includes an annular collar having an inner diameter generally equal to the first diameter and a plurality of radially extending and arcuately spaced slots which are axially aligned with the teeth and which accommodate passage of the teeth therethrough during movement of the housing between its operative and inoperative positions.

One of the principal features of the invention is a heat conducting member for a curling iron having a bore of rectilinear cross section and in which the heating element of the curling iron is supported axially within and diagonally across the bore.

Another of the principal features of the invention is a collapsible curling iron which includes means for supporting the heat conducting member of the curling iron so as to prevent side-to-side or "rocking" movement of the heat conducting member relative to the handle in a direction transverse the path of sliding movement of the heat conducting member, irrespective of the position of the heat conducting member.

Other features and advantages of the embodiments of the invention will become apparent upon reviewing the following general description, the drawings, and the appended claims.

Figure 1:
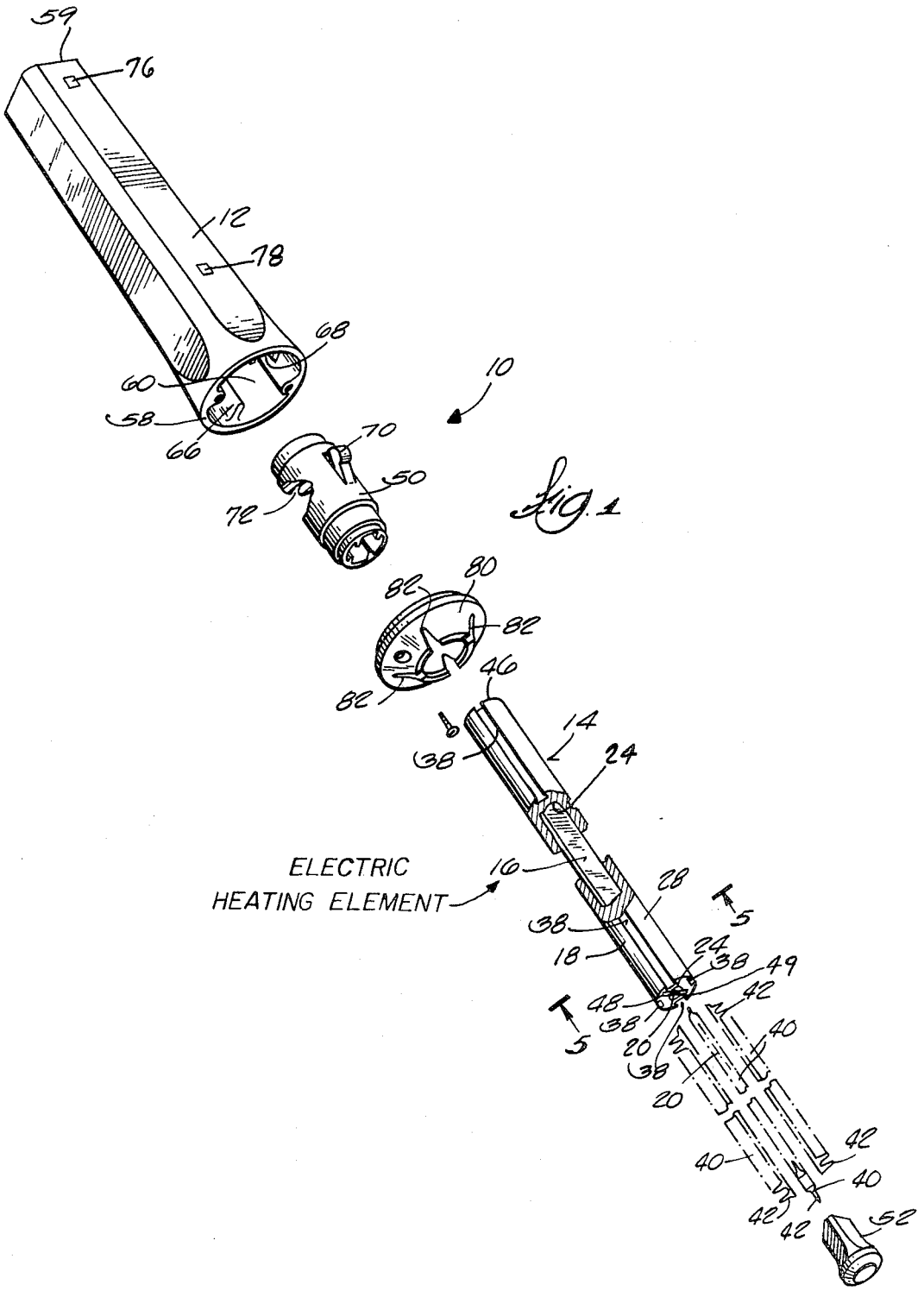
FIG. 1 is an exploded view of a collapsible curling iron with an associated heat conducting member.

Before explaining the embodiments of the invention in detail, it is to be understood that the invention is not limited in its application to the details of the construction and the arrangement of the components set forth in the following description and as illustrated in the drawings. The invention is capable of other embodiments and of being practiced and carried out in various ways. Also, it is to be understood that the phraseology and terminology used herein is for the purpose of description and should not be regarded as limiting.

GENERAL DESCRIPTION

Shown in FIG. 1 is a curling iron 10. Generally, the curling iron 10 includes a handle 12 and a heat conducting member 14 which extends from the handle 12. The heat conducting member 14 contains therein a heating element 16 which is adapted to be connected to a source of electrical energy (not shown) and which radiates heat which is transferred by the heat conducting member 14 to curl or otherwise style the operator's hair.

Figure 5:
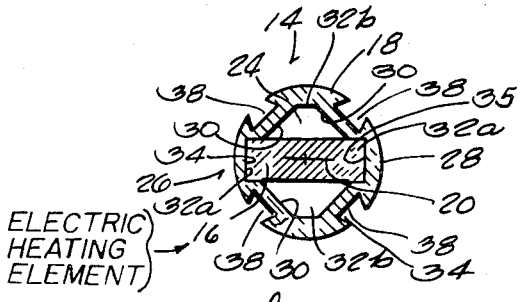
FIG. 5 is a sectional view of the heat conducting member of the curling iron taken generally along line 5—5 in FIG. 1.

In the illustrated embodiment, the heat conducting member 14 takes the form of a generally cylindrical housing 18 having an outer peripheral surface 28 and a longitudinal axis 20. While the housing 18 may be constructed of various materials, it is preferably made of a lightweight, heat conducting metal, such as aluminum. Referring now principally to FIG. 5, the housing 18 has interior wall means 22 which defines a chamber or bore 24 having a generally rectilinear cross section disposed perpendicularly to the longitudinal axis 20.

More particularly (and still referring principally to FIG. 5), the interior wall means 22 includes a series of adjoining, generally planar interior sidewalls 30 which are spaced inwardly of the outer peripheral surface 28 of the housing 18. Collectively, the adjoining interior sidewalls 30 form the rectilinear cross section of the interior chamber 24. While various rectilinear cross sections can be formed, in the illustrated embodiment, the interior sidewalls 30 collectively form a generally square interior chamber 24.

The interior wall means includes means for supporting the heating element 16 axially within and diagonally across the interior chamber 24 (see also FIG. 1). More particularly, diametrically spaced pairs of corner areas, respectively designated 32*a* and 32*b*, are formed by the juncture of the planar interior sidewalls 30. The supporting means includes means on one of the opposite pairs of corner areas (which, in the illustrated embodiment, is corner area pair 32*a*) for defining therein a diametrically spaced pair of axially extending channels 34 and 35. The heating element 16 is supported in the channels 34 and 35 axially within and diagonally across the interior chamber 24.

In the illustrated embodiment, a series of arcuately spaced grooves 38 extends longitudinally on the outer peripheral surface 28 of the housing 18 axially of the longitudinal axis 20. As can best be seen in FIG. 5, the grooves 38 are positioned so as to be radially spaced outwardly of each of the planar interior sidewalls 30.

While, in the illustrated embodiment,the grooves 38 are generally dovetail in shape (see FIG. 5), it should be appreciated that the specific shape of the grooves 38 may be varied from that shown in the drawings. For example, the grooves 38 may take the shape of any square, rectangular, or arcuate indentation formed on the outer peripheral surface 28 of the housing 18.

Figure 2:
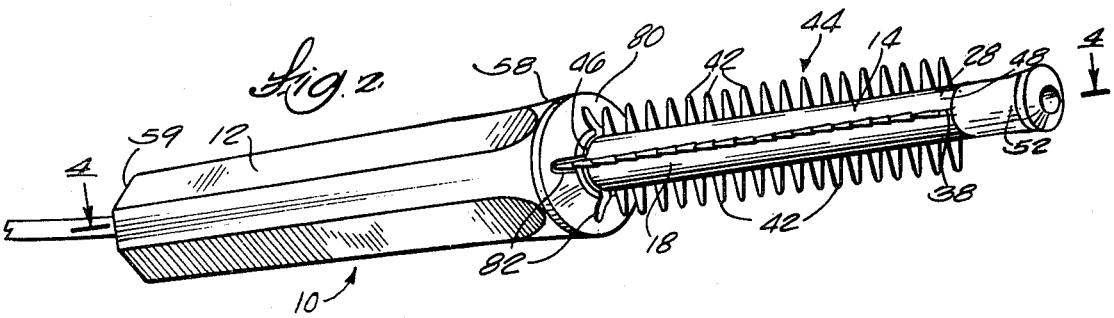
FIG. 2 is a perspective view of the curling iron of FIG. 1 in which the heat conducting member is shown in its extended position.
Figure 3:
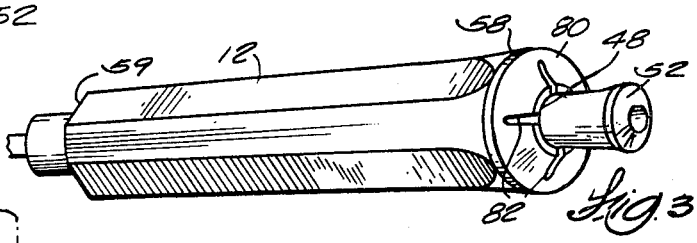
FIG. 3 is a perspective view of the curling iron of FIG. 1 in which the heat conducting member is shown in its retracted position.

As shown in FIG. 1, a support bar 40 is engagable in each of the grooves 38. While the support bars 40 may be constructed of various materials, they are preferably made of heat resistant plastic or rubber. A plurality of outwardly extending teeth or bristles 42 (also preferably of heat resistant plastic or rubber) are longitudinally spaced along each of the support bars 40. When each groove 38 is occupied by a support bar 40, as is shown in FIG. 2, the teeth or bristles 42 collectively form a hair grooming attachment 44 on the housing 18. The hair grooming attachment 44 enhances the use of the curling iron 10 to curl or otherwise style the operator's hair.

While the support bars 40 may be glued or otherwise fixedly engaged in the grooves 38, in the illustrated embodiment, the support bars 40 are fabricated so as to be individually slidable into and out of the dovetail grooves 38. The curling iron 10 is thus adaptable to be used with or without the hair grooming attachment 44 in place, depending upon the requirements of the particular hair curling operation desired.

In the illustrated embodiment, the housing 18 includes an inner end 46 adjacent to the handle 12 and an outer end 48 spaced outwardly of the handle 12. An inner cap 50 (see FIGS. 1 and 4) is glued or otherwise affixed on the inner end 46 of the housing 12. The inner end cap 50 surrounds the inner end 46 of the housing 12 and thereby closes off the grooves 38 at the inner end 46 to prevent movement of the support bars 40 beyond that point.

Figure 4:
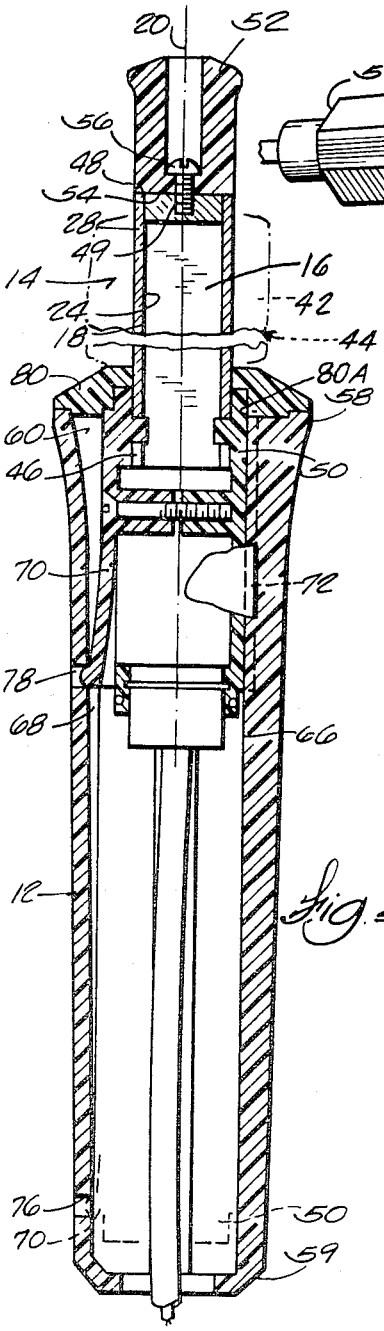
FIG. 4 is a side sectional view of the curling iron taken generally along line 4—4 in FIG. 2.

Additionally, and as is best shown in FIG. 4, the housing outer end 48 of the 18 includes an end member or plate 47 having an internally threaded hole 49 centrally formed therein. A plug-shaped outer tip member 52 having an outer diameter generally equal to the outer diameter of the housing 18 is provided. The tip member 52 includes an underbody portion 54 and an externally threaded pin 56 which projects downwardly from the center of the underbody portion 54. Rotation of the tip member 52 causes the pin 56 to threadably engage the hole 49 and to move the underbody portion 54 of the tip member 52 against the outer end 48 of the housing 18. When so attached, the tip member 52 prevents movement of the support bars 40 beyond the outer end 48 of the housing 18. Together, the end cap 50 and the removable plug-shaped tip member 52 retain the support bars 40 in the grooves 38. Likewise, by threadably disengaging the tip member 52 from the hole 49, the individual removal of each support bar 40 from the associated groove 38 is permitted.

The tip member 52 is preferably made of a heat resistant material, such as plastic or rubber. The operator is thus able to freely grasp the tip member 52 to facilitate handling of the curling iron 10 during hair curling operations, as well as to attach and remove the support bars 40 during operation of the heating element 16.

The heat conducting member 14 and associated hair grooming attachment 44 as heretofore described may be used in conjunction with various types of curling irons. For example, the heat conducting member 14 may be used on a curling iron (not shown) in which the heat conducting member is fixedly attached in an outwardly extending position from the handle. Alternately, and as shown in FIGS. 1 through 4, the heat conducting member 14 may be used in conjunction with a curling iron of telescopic or "collapsible" construction.

In this construction (and as best seen in FIG. 1), the handle 12, which is preferably made of heat resistant plastic or rubber, has opposite ends 58 and 59 and an interior opening 60 at one of these ends. In the illustrated embodiment, the interior opening 60 is found at opposite end 58. Means is provided on the handle 12 and on the inner end 46 of the housing 18 for movably mounting the inner end 46 of the housing 18 on the handle 12.

While various constructions are possible, in the illustrated embodiment, the mounting means includes a track 66 and an oppositely arranged groove 68 which together extend axially within the interior opening 60 of the handle 12. The mounting means further includes a corresponding track 70 and oppositely arranged groove 72 formed integrally on the inner end cap 50. As can be seen in FIG. 4, the end cap track 70 mates with the interior handle groove 68, and, similarly, the end cap groove 72 mates with the interior handle track 66.

By virtue of this construction, the housing 18 can be slidably moved relative to the handle 12 axially along the longitudinal axis 20 between an inoperative or collapsed position (shown in FIG. 3), in which the housing 18 is substantially wholly confined within the interior opening 60 of the handle 12, and an operative or extended position (shown in FIG. 2), in which the housing 18 extends from end 58 of the handle 12.

In the illustrated embodiment, the track 70 on the inner end cap 50 takes the form of a resiliently biased arm. Movement of the housing 18 within the handle 12 serves to yieldably engage the arm 70 into and out of a pair of axially spaced holes or detents 76 and 78 (see FIG. 4) formed in the interior of the handle 12. When the arm 70 is engaged in hole 76 (as shown in phantom lines in FIG. 4), the housing 18 is yieldably locked in its inoperative position. Likewise, when the arm 74 is engaged in hole 78 (as shown in solid lines in FIG. 4), the housing 18 is yieldably locked in its operative position.

Means 80 is provided on the handle end 58 for supporting the housing 18 to prevent side-to-side or "rocking" movement of the housing 18 relative to the handle 12 in a direction transverse the longitudinal axis 20, while at the same time permitting sliding movement of the housing 18 between its inoperative and operative positions. In the illustrated embodiment, the support means 80 takes the shape of an annular collar which is suitably attached, such as by gluing or by screws, on the handle end 58. The collar 80 has an inner diameter slightly larger than the outer diameter of the housing 18 to provide a snug, sliding fit therebetween and a counterbore 80A snugly receiving the end of cap 50 when the housing is in the operative position. The fit accommodates movement of the housing 18 along its longitudinal axis 20 between its operative and inoperative positions. The fit also supports the housing 18 adjacent to its inner end 46 (see FIG. 4) when the housing 18 is in its operative position and supports the housing 18 adjacent to its outer end 48 (see FIG. 2) when the housing 18 is in its inoperative position. The annular collar 80 thus effectively restrains the housing 18 against "rocking" movement transverse its longitudinal axis 20, regardless of the operative position of the housing 18.

In the illustrated embodiment, the heretofore described hair grooming attachment 44 is carried by the housing 18. In this embodiment, the annular collar 80 includes a plurality of radially extending and arcuately spaced slots 82 which are axially aligned with the teeth or bristles 42 of the grooming attachment 44 (see FIG. 2). The slots 82 thus accommodate passage of the teeth or bristles 42 therethrough during movement of the housing 18 between its operative and inoperative positions without detracting from the support lent to the housing 18 by the annular collar 80.

It should be appreciated that the collapsible curling iron as heretofore described need not include the particular heat conducting member 14. The collapsible curling iron may incorporate a heat conducting member of various designs and configurations.

Various of the features of the invention are set forth in the following claims.

I claim:

1. A heat conducting member for a curling iron, said heat conducting member containing therein an elongated heating element including relatively thin side edges, said heat conducting member comprising a housing having a longitudinal axis, said housing having interior wall means including a plurality of adjoining, generally planar interior sidewalls defining an interior chamber disposed perpendicularly to said longitudinal axis, said interior wall means also including means supporting said heating element axially within and diagonally across said interior chamber and including a diametrically spaced pair of corner areas formed by the juncture of adjoining ones of said planar interior sidewalls and including axially extending channels located in said pair of diametrically spaced corner areas and engagable with said side edges of said heating element.

2. A heat conducting member for a curling iron, said heat conducting member comprising a housing having a longitudinal axis, said housing also including a generally cylindrical outer peripheral surface radially spaced about said longitudinal axis and interior wall means including a plurality of adjoining, generally planar interior sidewalls each spaced inwardly of said outer peripheral housing surface, extending in generally chordal relationship, having a midpoint, and collectively forming an interior chamber, said housing further including means defining a groove extending axially on said outer peripheral housing surface and located radially outwardly of one of said planar sidewalls and generally aligned with said midpoint thereof, and a support bar removably received in said groove and including thereon means for grooming hair, and a heating element located in said interior chamber of said housing.

3. A heat conducting member according to claim 2 wherein a plurality of such grooves is provided, each generally aligned with said midpoint of a different sidewall, and further including a plurality of such support bars, each engagable in a different one of said grooves, and wherein said hair grooming means comprises a plurality of outwardly extending teeth longitudinally spaced along each of said support bars, said support bars collectively defining a hair grooming attachment when engaged in said grooves of said heat conducting member.

4. A heat conducting member according to claim 3 wherein said heating element is elongated and includes relatively thin side edges, and wherein said interior wall means includes a diametrically spaced pair of corner areas formed by the juncture of adjoining ones of said planar interior sidewalls, said corner areas including axially extending channels engageable with said side edges of said heating element.

5. A curling iron comprising a handle, an elongated heating element having relatively thin side edges and adapted to be connected to a source of electrical energy, and a housing extending from said handle and having a longitudinal axis, said housing including interior walls means including a plurality of adjoining, generally planar interior sidewalls defining a chamber, said interior wall means also including means engaging and supporting said heating element axially within and diagonally across said interior chamber and including a diametrically spaced pair of corner areas formed by the juncture of adjoining ones of said planar interior sidewalls and including axially extending channels in said pair of diametrically spaced corner areas engagable with said side edges of said heating element.

6. A curling iron comprising a handle, a housing extending from said handle and having a longitudinal axis, said housing also including a generally cylindrical outer peripheral surface radially spaced from said longitudinal axis and interior wall means including a plurality of adjoining, generally planar interior sidewalls spaced inwardly of said outer peripheral housing surface, extending in generally chordal relationship, having a midpoint, and collectively forming an interior chamber, said housing further including means defining a groove extending axially on said outer peripheral surface and located radially outwardly of one of said said planar sidewalls and generally aligned with said midpoint thereof, a support bar removably received in said groove and including thereon means for grooming hair, and a heating element located in said interior chamber of said housing.

7. A curling iron according to claim 6 wherein a plurality of such grooves is provided, each generally aligned with the midpoint of a different sidewall, and further including a plurality of such support bars, each engagable in a different one of said grooves, and wherein said hair grooming means comprises a plurality of outwardly extending teeth longitudinally spaced along each of said support bars and collectively defining a hair grooming attachment for said curling iron when said support bars are engaged in said grooves.

8. A curling iron according to claim 7 wherein said heating element is elongated and includes relatively thin side edges, and wherein said interior wall means includes a diametrically spaced pair of corner areas formed by the juncture of adjoining ones of said planar interior sidewalls, said corner areas including axially extending channels engaging said side edges of said heating element.

9. A collapsible curling iron comprising a handle having opposite ends and a hollow interior with an opening at one of said ends, a heating element adapted to be connected to a source of electrical energy, a housing having oppositely spaced inner and outer ends and a longitudinal axis extending therebetween, said housing also having a bore extending along said longitudinal axis and accommodating therein said heating element, said outer end of said housing also including a generally cylindrical outer peripheral surface, and said inner end of said housing having a cap with a diameter greater than the diameter of said outer peripheral surface, a plurality of longitudinally extending and arcuately spaced rows of teeth extending radially from said housing a given distance outwardly of said outer peripheral surface, means on said handle and on said inner end of said housing for mounting said inner end of said housing in said handle for movement of said housing relative to said handle axially through said opening and along said longitudinal axis between an inoperative position in which said housing and said radially extending teeth are substantially wholly confined within said interior of said handle and an operative position in which said housing extends from said one end of said handle and said teeth are located exteriorly of said handle, and means on said one end of said handle for supporting said housing so as to prevent movement of said housing relative to said handle in a direction transverse said longitudinal axis while permitting movement of said housing between said inoperative and operative positions, said supporting means including an annular collar on said one handle end and providing said opening, said collar including a plurality of radially extending and arcuately spaced slots, said slots being axially aligned with said rows of teeth and accommodating passage of said teeth therethrough during movement of said housing between said operative and inoperative positions, said collar opening including an inner diameter slidingly engaging said housing outer peripheral surface between said arcuately spaced slots and said collar also having an interior counterbore dimensioned to snugly receive said cap of said housing when said housing is in the operative position.

10. A collapsible curling iron comprising a handle having opposite ends and a hollow interior opening at one of said ends, an elongated heating element having relatively thin side edges and adapted to be connected to a source of electrical energy, a housing having oppositely spaced first and second ends and a longitudinal axis extending therebetween, said housing also including interior wall means including a plurality of adjoining, generally planar interior sidewalls defining an interior chamber, said interior wall means also including means for supporting said heating element axially within and diagonally across said interior chamber and including a diametrically spaced pair of corner areas formed by the juncture of adjoining ones of said planar interior sidewalls and including axially extending channels located in said pair of diametrically spaced corner areas and engagable with said side edges of said heating element, means on said handle and on said first end of said housing for mounting said first end of said housing on said handle for movement of said housing relative to said handle axially along said longitudinal axis between an inoperative position in which said housing is substantially wholly confined within said interior opening of said handle and an operative position in which said housing extends from said one end of said handle, and means on said one end of said handle for supporting said housing so as to prevent movement of said housing relative to said handle in a direction transverse said longitudinal axis while permitting movement of said housing between said inoperative and operative positions.

11. A collapsible curling iron comprising a handle having opposite ends and an interior opening at one of said ends, a housing having oppositely spaced first and second ends and a longitudinal axis extending therebetween, said housing also including a generally cylindrical outer peripheral surface radially spaced from said longitudinal axis and interior walls means including a plurality of adjoining, generally planar interior sidewalls each spaced inwardly of said outer peripheral housing surface, extending in generally chordal relationship, having a midpoint, and collectively forming an interior chamber having therein said heating element, said housing further including means defining a groove extending axially on said outer peripheral housing surface and located radially outwardly of one of said planar sidewalls and generally aligned with said midpoint thereof, a support bar removably received in said groove and including thereon means for grooming hair, a heating element located in said hollow interior of said housing, means on said handle and on said first end of said housing for mounting said first end of said housing on said handle for movement of said housing relative to said handle axially along said longitudinal axis between an inoperative position in which said housing is substantially wholly confined within said interior opening of said handle and an operative position in which said housing extends from said one end of said handle, and means on said one end of said handle for supporting said housing so as to prevent movement of said housing relative to said handle in a direction transverse said longitudinal axis while permitting movement of said housing between said inoperative and operative positions.

12. A collapsible curling iron according to claim 11 wherein a plurality of such grooves is provided, each generally aligned with the midpoint of a different sidewall and further including a plurality of said support bars, each engagable in a different one of said grooves and wherein said hair grooming means comprises a plurality of outwardly extending teeth longitudinally spaced along each of said support bars, said support bars collectively defining a hair grooming attachment for said collapsible curling iron when said support bars are engaged in said grooves.

13. A collapsible curling iron according to claim 12 wherein said heating element is elongated and includes relatively thin side edges, and wherein said interior wall means includes a diametrically spaced pair of corner areas formed by the juncture of adjoining ones of said planar interior sidewalls, said corner areas including axially extending channels engaging said side edges of said heating element.

* * * * *